US005990434A

United States Patent [19]

Fujihira et al.

[11] Patent Number: 5,990,434

[45] Date of Patent: Nov. 23, 1999

[54] SWITCHING MECHANISM FOR CIRCUIT BREAKER

[75] Inventors: Takumi Fujihira; Tatunori Takahashi; Naoshi Uchida; Katunori Kuboyama; Hiroaki Tosaka; Kentaro Toyama; Koji Nomura; Isamu Nagahiro, all of Saitama, Japan

[73] Assignee: Fuji Electric Co., Ltd., Kawasaki, Japan

[21] Appl. No.: 09/144,179

[22] Filed: Aug. 31, 1998

[30] Foreign Application Priority Data

Sep. 3, 1997 [JP] Japan ..... 9-254283

[51] Int. Cl.[6] ..... H01H 23/00

[52] U.S. Cl. ..... 200/401; 335/6; 335/21; 335/166; 335/172

[58] Field of Search ..... 335/6, 21, 22, 335/166, 167, 172, 174, 176, 177; 200/401

[56] References Cited

U.S. PATENT DOCUMENTS 3,605,052 9/1971 Dimond et al. ..... 335/166
4,786,771 11/1988 Iio et al. ..... 200/153 G
5,082,996 1/1992 Takahashi et al. ..... 200/401

*Primary Examiner*—Lincoln Donovan
*Assistant Examiner*—Tuyen T. Nguyen
*Attorney, Agent, or Firm*—Kanesaka & Takeuchi

[57] ABSTRACT

A switching mechanism for a circuit breaker includes a frame; a latch rotatably supported on the frame; a holder rotatably supported on the frame and having a movable contact; a handle lever rockably supported on the frame by lever shafts; a toggle link formed of first and second links rotationally connected by a toggle shaft; and a switching spring. A free end of the first link is rotatably connected to the latch, and a free end of the second link is rotatably connected to the holder. The first and second links generally overlap each other to reduce the movement range of the toggle link to miniaturize a switching mechanism. The switching spring is situated between the toggle shaft and the handle lever at a side opposite to a switching handle with respect to the lever shaft. When the handle lever is moved, operational force of the switching spring relative to the toggle link is reversed to rotate the holder with the movable contact, and when the latch is disengaged, the operational force of the switching spring relative to the toggle link is reversed to rapidly rotate the holder to thereby trip the movable contact.

8 Claims, 4 Drawing Sheets

SWITCHING MECHANISM FOR CIRCUIT BREAKER

BACKGROUND OF THE INVENTION AND RELATED ART STATEMENT

The present invention relates to a switching mechanism for a circuit breaker, such as a molded circuit breaker for wiring and earth leakage breaker, and in particular, to a switching mechanism for the circuit breaker to reduce an operating space.

FIG. 6 is a vertical sectional view showing a general configuration of a conventional switching mechanism for a three-pole circuit breaker in a closed-circuit state, and FIG. 7 is a top view of a main portion of the switching mechanism of FIG. 6. In these figures, the switching mechanism has a latch 4 having one end rotatably supported by a latch shaft 3 on one of a laterally disposed pair of side plates of a frame 2 fixed to a case 1 of a circuit breaker body, and the other end generally engaging a latch receiver (not shown); a holder 7 made of an insulating material for holding a movable contact 5 and rotatably supported on the case 1 via an integral switching shaft 6; a gate-shaped handle lever 10 rockably supported on the side plates of the frame 2 around lever shafts 8 and having a switching handle 9 installed at its head; a toggle link 16 consisting of a laterally disposed pair of first and second links 12, 13, with ends of the first and second links 12, 13 being connected together by a toggle shaft 11, a free end of the first link 12 being connected to the latch 4 by a shaft 14 and a free end of the second link 13 being connected to the holder 7 by a shaft 15; and a laterally disposed pair of switching springs 17, each being stretched between the toggle shaft 11 and the head of the handle lever 10.

In the illustrated closed state, due to the tension of the switching springs 17 on the toggle shaft 11, the toggle link 16 extends in such a way that an axis 18 joining the connection point (central point of the shaft 14) between the first link 12 and the latch 4 with the central point of the toggle shaft 11 is nearly linear with an axis 19 joining the connection point (central point of the shaft 15) between the second link 13 and the holder 7 with the central point of the toggle shaft 11. The holder 7 is subjected to a counterclockwise rotational force in FIG. 6 around the switching shaft 6, thereby pressing the movable contact 5 against a fixed contact shoe 20.

When the switching handle 9 is gripped to rotate the handle lever 10 clockwise in FIG. 6, the effect of the switching springs 17 on the toggle link 16 is inverted at a dead point at which an axis 22 passes the axis 18 of the first link 12 from left to right, wherein the axis 22 is a line joining the connection point 21 between one switching spring 17 and the handle lever 10 with the central point of the toggle shaft 11. Thus, the toggle link 16 is bent in a V-shape at the end of the handle lever 10, and the holder 7 is rotationally driven clockwise in FIG. 6 to separate the movable contact 5 from a fixed contact 20 (opening operation). In addition, in this open-circuit state, when the handle lever 10 is rotationally operated counterclockwise, the effect of the switching spring 17 is reversed at the dead point at which the axis 22 of the switching spring 17 passes the axis 18 of the first link 12 from right to left. The movable contact 5 is then contacted with the fixed contact 20 as shown in the figure (closing operation).

Furthermore, when a current flowing through the circuit breaker becomes excessive to activate an overcurrent trip apparatus (not shown), the latch 4 is disengaged from the latch receiver to rotate the latch 4 urged by the switching springs 17 via the first link 12 counterclockwise in FIG. 6 around the latch shaft 3. As a result, the effect of the switching springs 17 on the toggle link 16 is inverted at the dead point at which the axis 18 passes the axis 22 from right to left. The toggle link 16 is then bent in the V-shape to rotationally drive the holder 7 clockwise in FIG. 6, thereby separating the movable contact 5 from the fixed contact 20 (tripping operation).

In the conventional switching mechanism, the connection point between the first link 12 and the latch 4 is located in a nearly opposite position relative to the connection point between the second link 13 and the holder 7 with respect the toggle shaft 11. Thus, when the toggle link 16 is straightened, the height of the mechanism increases, and when the link 16 is bent, the movement range of the first and second links 12 and 13 is wide. Thus, the reduction of the installation space is very difficult.

It is an object of this invention to reduce the installation space for the switching mechanism in order to miniaturize the circuit breaker.

SUMMARY OF THE INVENTION

In the prior art, the switching spring is held between the toggle shaft connecting the first and second links of the toggle link together and the head of the handle lever, and the toggle link is straightened or bent to rotate the holder clockwise or counterclockwise in order to separate or contact the movable and fixed contacts. On the other hand, in the invention, the first and second links are moved to rotationally drive the holder counterclockwise or clockwise in order to separate or contact the movable and fixed contact, while they are generally overlapping each other in order to reduce the movement range of the toggle link. In addition, in order to rotate the handle lever to allow the switching spring to pass a dead point relative to the toggle link, one end of the switching spring is connected to the toggle shaft of the toggle link, and the other end thereof is connected not to the head of the handle lever but to the end of the handle lever opposite to its head with respect to the lever shaft.

In the switching mechanism, it is preferable that a reset pin is attached to the end of the handle lever, to which an end of the switching spring is attached, and that the handle lever is operated to push up, using the reset pin, the latch that is disengaged by a tripping operation so that it is reengaged with the latch.

DETAILED DESCRIPTION OF PREFERRED EMBODIMENT

Figure 1:
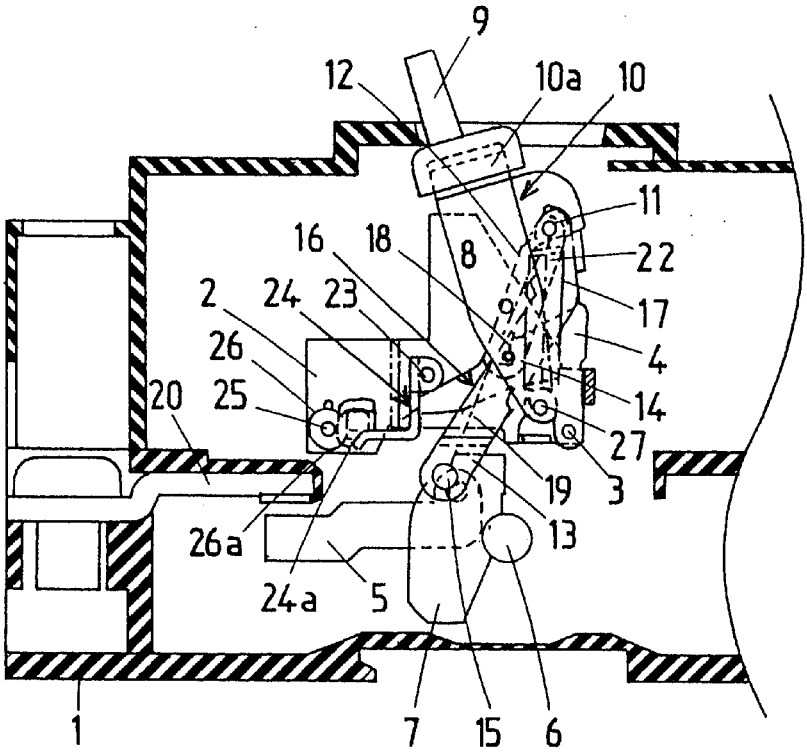
FIG. 1 is a side view of a switching mechanism in a closed-circuit state showing an embodiment of this invention.
Figure 2:
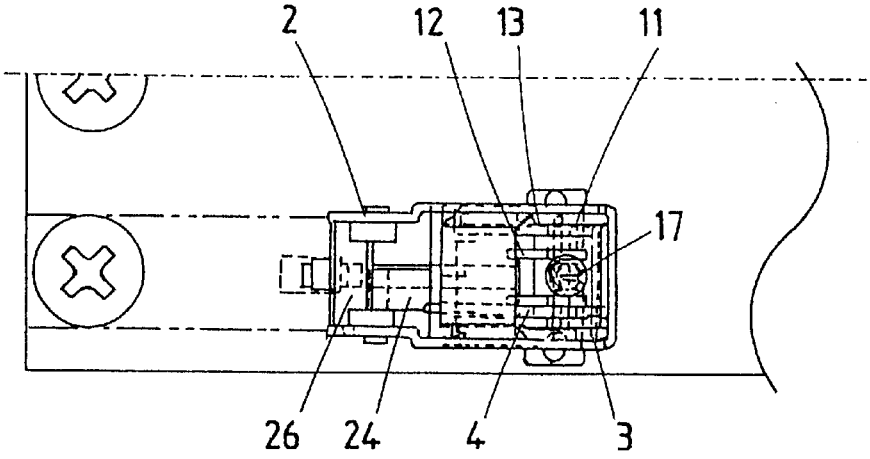
FIG. 2 is a top plan view of the switching mechanism shown in FIG. 1.
Figure 3:
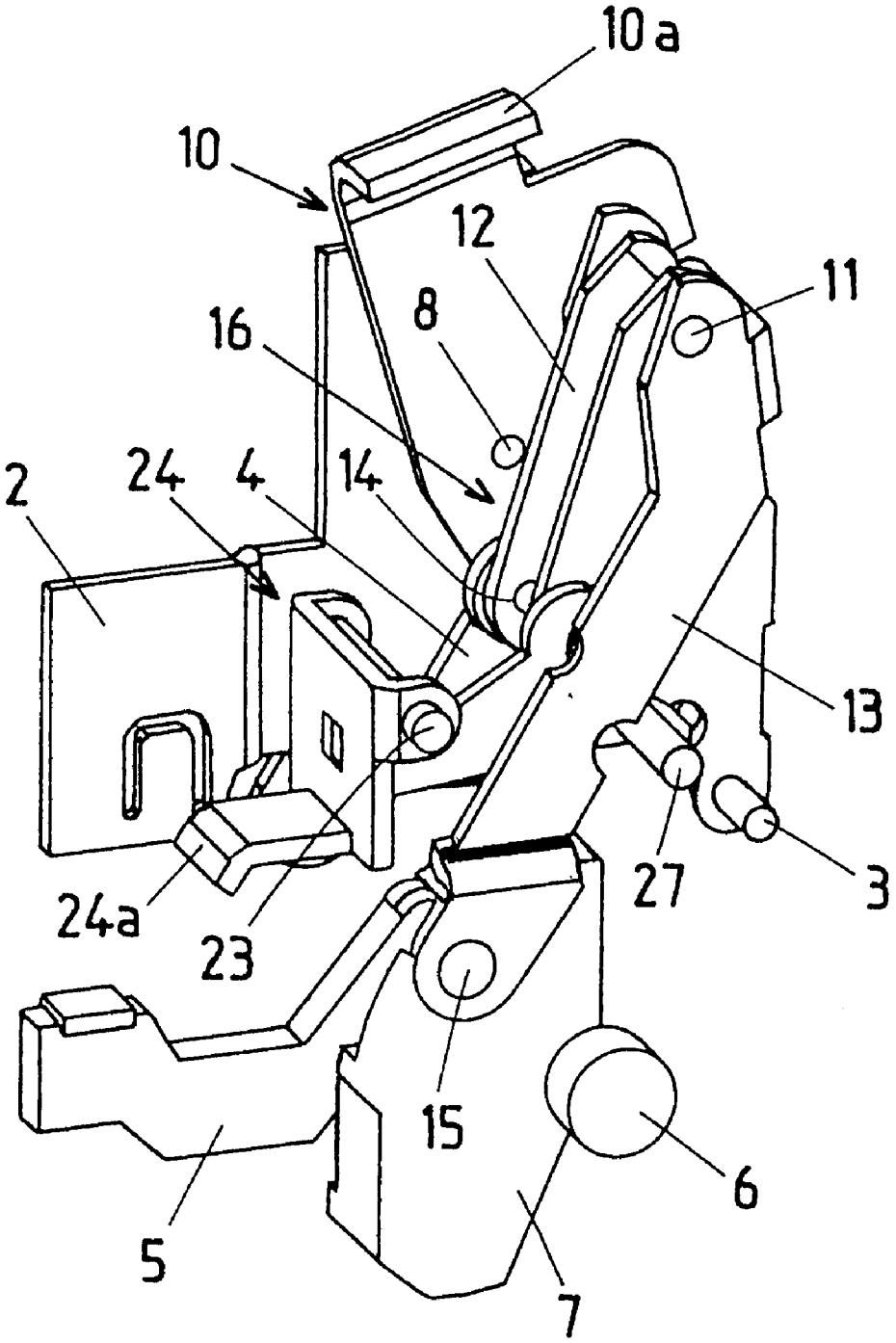
FIG. 3 is a perspective view of the switching mechanism shown in FIG. 1.
Figure 4:
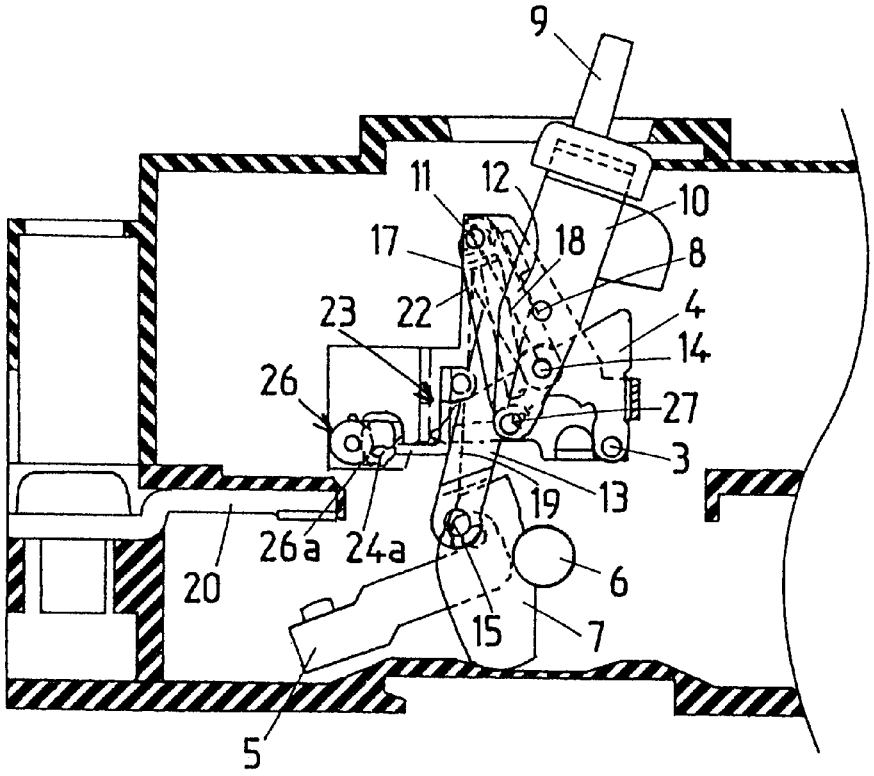
FIG. 4 is a side view of a main portion of the switching mechanism shown in FIG. 1 at an open-circuit state.
Figure 5:
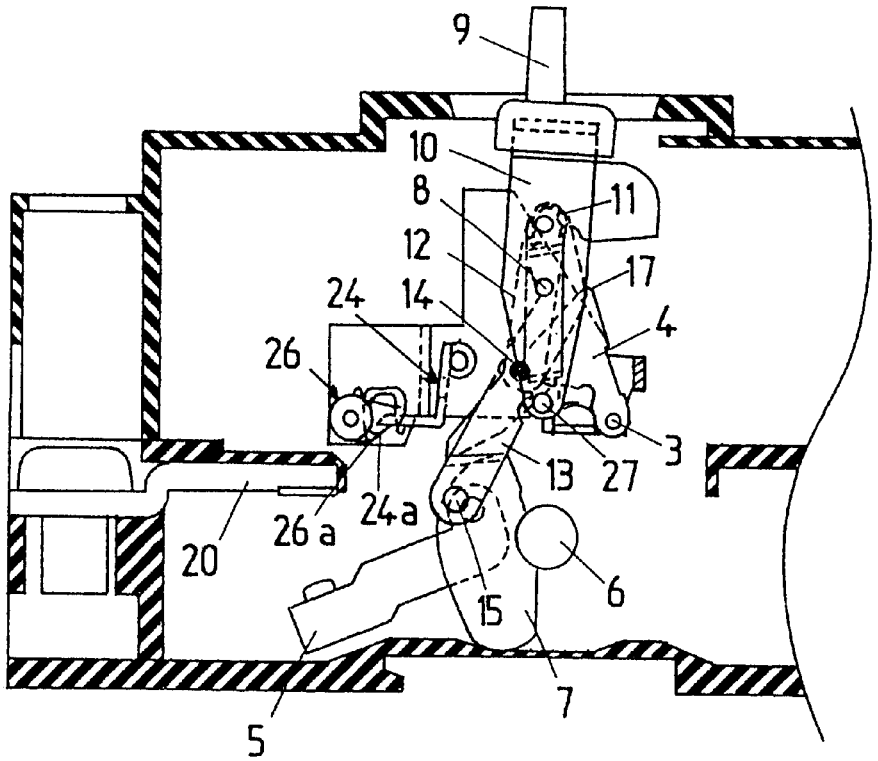
FIG. 5 is a side view of a main portion of the switching mechanism shown in FIG. 1 at a tripped state.
Figure 6:
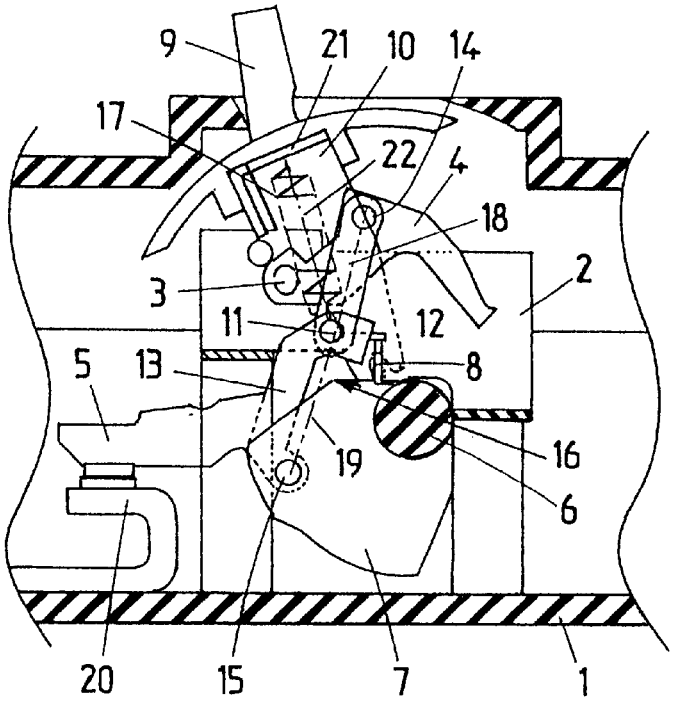
FIG 6 Prior Art
FIG. 6 is a side view of a switching mechanism in a closed-circuit state according to a conventional device.
Figure 7:
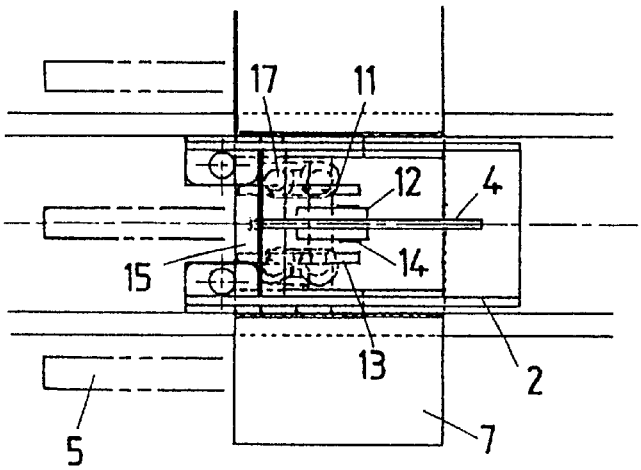
FIG 7 Prior Art
FIG. 7 is a top plan view of a main portion of the switching mechanism shown in FIG. 6.

FIGS. 1 to 5 show an embodiment of this invention. FIG. 1 is a side view showing a main part of a switching mechanism in its closed-circuit state; FIG. 2 is a top plan view; FIG. 3 is a perspective view of FIG. 1; and FIGS. 4 and 5 are side views of the main portion of FIG. 1 in its open-circuit and tripped states. The components corresponding to the conventional example have the same reference numerals. In FIGS. 1 to 3, a V-shaped latch 4 is rotatably supported by latch shafts 3 at the end thereof on a laterally disposed pair of side plates (only one side of the latch 4 is shown in FIG. 3) of a frame 2 fixed to a case 1, and the tip of the latch is engaged with an L-shaped latch receiver 24 rotatably supported by a pin 23 onto the frame 2. A tip 24*a* of the latch receiver 24 is engaged with a claw 26*a* (FIG. 1) of a trip cross bar 26 rotatably supported by a pin 25 on the frame 2.

A toggle link 16 comprises a first link 12 with two arms and a second link 13 with two arms, the first link 12 and the second link 13 being connected together at the ends by a toggle shaft 11. The first and second links 12, 13 generally overlap each other, wherein the free end of the first link 12 is connected to the latch 4 with the shafts 14, and the free end of the second link 13 is connected by shafts 15 to a holder 7 (only a right half is shown in FIG. 3) which drives a movable contact 5. A handle lever 10 with an operation handle 9 (FIG. 1) on its head 10*a* is rockably or swingably supported by lever shafts 8 on the frame 2, and a reset pin 27 is attached to the handle lever 10 opposite to the head 10*a* with respect to the lever shafts 8. One end of a switching spring 17 operating as an extension coil (FIG. 1) is attached onto the toggle shaft 11, while the other end is attached onto the reset pin 27.

The latch 4, first link 12, second link 13 and handle lever 10 are respectively constructed with a laterally disposed pair of arms as shown in FIG. 3 (in FIG. 3, only the left half of the handle lever 10 is shown). In addition, as shown in FIG. 2 as an example, the switching mechanism is only located for a right or one polar line of the illustrated three-pole circuit breaker, and when the holder 7 for the right pole is rotationally driven, two other holders for the central and left poles (not shown) are also driven simultaneously, because they are integrally coupled together with the switching shaft 6.

In the closed-circuit state in FIG. 1, the switching spring 17 is in a stretched condition, wherein the handle lever 10 is held in the illustrated closed position due to a counterclockwise rotational force around the lever shafts 8, and the first link 12 of the toggle link 16 is subjected to a clockwise rotational force around the shafts 14. An axis 18 joining the connection point (central point of the shaft 14) between the first link 12 and the shaft 14 with the central point of the toggle shaft 11 is located to the right side of an axis 19 in the FIG. 1, which is a line joining the connection point (central point of the shaft 15) between the second link 13 and the holder 7 with the central point of the toggle shaft 11. Thus, on the right side of the axis 19, a circular locus of the toggle shaft 11 that is drawn when the first link 12 rotates clockwise around the shaft 14 is set radially outside a circular locus of the toggle shaft 11 that is drawn when the second link 13 rotates clockwise around the shaft 15.

Consequently, when the first link 12 is subjected to a clockwise rotational force caused by the tension of the switching spring 17 around the shafts 14, the second link 13 is lifted via the toggle shaft 11. As a result, the holder 7 is subjected to a clockwise rotational force from the second link 13 around the switching shafts 6, thereby pressing the movable contact 5 against the fixed contact 20. The movable contact 5 is urged clockwise in advance by a contact spring (not shown), which is rotatably supported by the holder, and the contact spring is slightly deformed during the closed-circuit state in FIG. 1 to apply an appropriate contact pressure between the movable and fixed contacts 5, 20.

On the other hand, the latch 4 urged by the switching spring 17 via the first link 12 is subjected to a counterclockwise rotational force around the latch shafts 3, but its tip is engaged with the latch receiver 24 and is prevented from rotation. The latch receiver 24, the rear surface of which is pressed with the latch 4, is subjected to a clockwise rotational force around the pin 23. Its tip 24*a*, however, is engaged with the claw 26*a* of the trip cross bar 26 and prevented from rotation.

In the ON state in FIG. 1, when the operation handle 9 is moved to the right to rotate the handle lever 10 clockwise around the lever shaft 8, the effect of the switching spring 17 on the first link 12 is inverted at the dead point at which the axis 22 of the switching spring 17 passes the axis 18 of the first link 12 from right to left in the figure. Thus, the first link 12 rotates counterclockwise around the shafts 14. As described above, on the left of the axis 19 of the second link 13, a circular locus of the toggle shaft 11 that is drawn when the first link 12 rotates around the shafts 14 counterclockwise is set radially inside a circular locus of the toggle shaft 11 that is drawn when the second link 13 rotates around the shafts 15 counterclockwise. Consequently, when the first link 12 is subjected to a counterclockwise rotational force caused by the tension of the switching spring 17 around the shafts 14, the second link 13 is pressed downward via the toggle shaft 11. As a result, the holder 7 is subjected to a counterclockwise rotational force from the second link 13 around the switching shafts 6, thereby separating the movable contact 5 from the fixed contact 20 (opening operation). FIG. 4 shows this open-circuit state, and when the operation handle 9 is moved leftward again, the steps reverse to the above opening operation are performed to return the switching mechanism to the state shown in FIG. 1 (closing operation).

On the other hand, when a large current, e.g. a short-circuit current, flows through the circuit breaker, an overcurrent trip apparatus (not shown) is activated to rotate the trip cross bar 26 clockwise. This operation disengages the claw 26*a* from the latch receiver 24 to allow the latch receiver 24 to rotate clockwise, thereby disengaging the latch 4, which is then rotated counterclockwise via the first link 12 by the tension of the switching spring 17. In response to this, the holder 7 is rotated counterclockwise via the second link 13 to separate the movable contact 5 from the fixed contact 20 (tripping operation) as shown in FIG. 5. The lowering of the toggle link 16 causes the handle lever 10 to rotate clockwise around the lever shafts 8, thereby moving the operation handle 9 to between the closed-circuit position and the open-circuit position for a trip indication.

In FIG. 5, to reset the switching mechanism that has performed a trip operation, the operation handle 9 is moved rightward from the trip position to the open-circuit position. The latch 4 is then lifted by the reset pin 27 formed at the tip of the handle lever 10 and rotated clockwise. The tip of the latch 4 then reengages the latch receiver 24 to allow the latch 4 to become the open-circuit state in FIG. 4 again. When the operation handle 9 is then moved leftward to the closed-circuit position, the switching spring 17 is drawn to retain the tensile force therein in order to re-close the movable contact 5 as shown in FIG. 1. Although not shown, the latch receiver 24 and trip cross bar 26 have respective return springs that continuously urge them counterclockwise and that cooperate during the reset operation.

According to the embodiment shown above, the toggle link 16 performs the switching and tripping operations in a condition that the first and second links 12 and 13 generally overlap each other. Thus, the height and the depth (vertical and horizontal dimensions in FIG. 1) necessary for rotation of the toggle link 16 is small. This configuration reduces the longitudinal space required for the switching mechanism as compared to the conventional configuration in which the toggle link bends and extends in response to the switching operation.

By reducing the movement range of the toggle link, this invention can reduce the installation space for the switching mechanism and thus the size of the circuit breaker.

What is claimed is:

1. A switching mechanism for a circuit breaker, comprising:

a frame;

a latch rotatably supported on the frame;

a holder rotatably supported on the frame and having a movable contact;

a handle lever having a lever shaft and a switching handle on an upper side, and rockably supported on the frame by the lever shaft;

a toggle link having a first link with first and second ends, a second link with third and fourth ends, and a toggle shaft, said first end being rotatably connected to the latch, said second and third ends being rotatably connected together by the toggle shaft so that the first and second links generally overlap each other while axial lines passing through centers of the first and second links intersect with each other with an acute angle, and said fourth end being rotatably connected to the holder; and a switching spring having one end connected to the toggle shaft and the other end connected to the handle lever at a side opposite to the switching handle with respect to the lever shaft to provide an operational force so that when the handle lever is moved, the operational force of the switching spring relative to the toggle link is changed to rotate the holder with the movable contact.

2. A switching mechanism for a circuit breaker according to claim 1, wherein said handle lever includes a reset pin, to which the other end of the switching spring is attached, so that when the reset pin is moved by the handle lever in a condition of a disengagement of the latch by a tripping operation, the latch is moved to an engaging position by the reset pin.

3. A switching mechanism for a circuit breaker according to claim 2, further comprising a latch receiver rotationally connected to the frame, said latch engaging the latch receiver for providing the tripping operation so that when the latch is disengaged from the latch receiver, the operational force of the switching spring relative to the toggle link is reversed to rapidly rotate the holder to thereby trip the movable contact.

4. A switching mechanism for a circuit breaker according to claim 1, wherein said first and second links, the latch and the handle lever include two arms, respectively, said arms of the first link being shorter than the arms of the second link and disposed between the arms of the second link.

5. A switching mechanism for a circuit breaker according to claim 4, wherein said latch is located between the arms of the second link, while the arms of the handle lever partly cover the arms of the second link.

6. A switching mechanism for a circuit breaker according to claim 1, wherein said switching spring has an axial line passing through a center thereof so that when the handle lever is moved, the axial line of the switching spring passes through the axial line of the first link to rotate the holder by the switching spring.

7. A switching mechanism for a circuit breaker according to claim 1, wherein said toggle shaft is located above the first and fourth ends.

8. A switching mechanism for a circuit breaker according to claim 1, wherein said toggle shaft is located closer to the switching handle than the first and fourth ends.

* * * * *